US007544111B2

(12) United States Patent
Isberg et al.

(10) Patent No.: US 7,544,111 B2
(45) Date of Patent: Jun. 9, 2009

(54) PUNCTURE DEVICE FOR AN INFLATABLE UNIT

(75) Inventors: Erik Isberg, Ellös (SE); Tor Christiansson, Skeppshult (SE)

(73) Assignee: P&P AB, Vastra Frolunda (SE)

( * ) Notice: Subject to any disclaimer, the term of this patent is extended or adjusted under 35 U.S.C. 154(b) by 24 days.

(21) Appl. No.: 11/491,958

(22) Filed: Jul. 25, 2006

(65) Prior Publication Data

US 2008/0038970 A1 Feb. 14, 2008

(30) Foreign Application Priority Data

Jul. 24, 2006 (SE) ..... 0601599

(51) Int. Cl.
*B63C 9/15* (2006.01)
*B60R 21/26* (2006.01)
*B67D 5/00* (2006.01)

(52) U.S. Cl. ..... 441/93; 280/737; 222/5

(58) Field of Classification Search ..... 441/93
See application file for complete search history.

(56) References Cited

U.S. PATENT DOCUMENTS 3,059,814 A 10/1962 Poncel et al.
4,232,417 A * 11/1980 Miller et al. ..... 441/30
4,927,057 A * 5/1990 Janko et al. ..... 222/5
5,413,247 A 5/1995 Glasa
5,660,413 A 8/1997 Bergerson et al.
5,720,495 A 2/1998 Faigle et al.
6,189,926 B1 * 2/2001 Smith ..... 280/737
6,412,811 B1 * 7/2002 Campbell et al. ..... 280/730.2
2003/0057684 A1 3/2003 Freesmeier

FOREIGN PATENT DOCUMENTS

DE 296 06 782 8/1997
FR 2 848 982 6/2004
WO WO 03/051685 6/2003

OTHER PUBLICATIONS

International Search Report mailed Dec. 11, 2007 for corresponding International Application No. PCT/SE2007/000579.

* cited by examiner

*Primary Examiner*—Jesus D Sotelo
(74) *Attorney, Agent, or Firm*—Harness, Dickey & Pierce, P.L.C.

(57) ABSTRACT

The present invention relates to a gas management device 10; 20; 30; 40; 50 comprising: a gas inlet 11; 32; 42; 52 adapted to secure a casing of a vessel 22, preferably a closure 26 sealing an opening of a gas cylinder containing pressurized gas; a gas outlet 12; 33; 43; 53 adapted to be secured to an inflatable unit 23; and a puncture device 10*b*; 31*b*; 41*b*; 51*b* for puncturing the casing of the vessel 22. The puncture device 10*b*; 31*b*; 41*b*; 51*b* comprises a pyrotechnical detonator 16 that, when activated, creates a chock wave which punctures the casing of the vessel 22, whereby gas from the vessel 22 is directed to the inflatable unit 23. The invention also relates to a method and a system for transferring gas from a pressurized vessel to an inflatable unit via a gas management device.

18 Claims, 4 Drawing Sheets

PUNCTURE DEVICE FOR AN INFLATABLE UNIT

TECHNICAL FIELD

The present invention relates to a gas management device including a puncture device for an inflatable unit, especially for life jackets. The invention also relates to a method and a system for transferring gas from a pressurized gas cylinder to an inflatable unit using a gas management device.

BACKGROUND

It is well known from the prior art to transfer pressurized gas from a cylinder into an inflatable unit, such as a life jacket or raft, using a puncture device. When a mechanism automatically detects the presence of water or when the puncture device is manually activated, a sharp object is normally moved towards a sealing closure of the gas cylinder. The movement of the sharp object will eventually penetrate and puncture the closure and the pressurized gas flows from the gas cylinder and into the inflatable unit.

For instance, U.S. Pat. No. 5,413,247 by Glasa, describes a system wherein a sharp object is mechanically moved using a spring loaded force. Alternatively, the force needed to advance the sharp object could be provided by a pyrotechnical charge. In both cases the dimension of the sharp object will determine the size of the hole when retracted.

In addition, a German utility model DE 296 06 782 U1 describes an automatic rescue device for sea and air transport including a water sensor. A puncture device is briefly discussed, which is used to open a pressurized gas cylinder. The puncture device could be implemented as a chemical reaction unit, and more specifically be constructed as a pyrotechnical detonator situated outside the gas management device through which the gas flow when the gas cylinder is opened. A hollow needle could also be used for manually puncturing the closure of the gas cylinder if needed.

SUMMARY

An object with the present invention is to provide a gas management device that more rapidly will assist an inflatable unit to inflate compared to the prior art.

A solution to the object is achieved by a gas management device, wherein a pyrotechnical detonator is integrated into the gas management device and placed adjacent to a gas inlet. A casing of a pressurized vessel, preferably a closure of a gas cylinder will, when secured to the gas management device, be very close to the pyrotechnical detonator. When the pyrotechnical detonator is activated, a chock wave is created that will puncture the casing and release the gas from the pressurized vessel.

A further object with the present invention is to provide a method and a system for transferring gas from a pressurized vessel to an inflatable unit more rapidly than prior art methods.

An advantage with the present invention is that an aperture in the casing of the pressurized vessel, preferably the closure of the gas cylinder, is created that is larger than the opening created by prior art techniques, whereby an inflatable unit is filled more rapidly when the pyrotechnical detonator is activated.

DETAILED DESCRIPTION OF PREFERRED EMBODIMENTS

The purpose of the invention is, in short, to replace the mechanical function to penetrate and puncture a pressurized vessel, e.g. a sealed opening of a pressurized gas cylinder with a puncture device, e.g. an electrically controlled puncture device without any mechanically movable parts. Prior art uses a sharp object to penetrate the sealed opening, and by replacing it with a pyrotechnical detonator with directional bursting effect arranged adjacent to the sealed opening a large aperture will be created by a chock wave through the sealed opening. The large aperture will allow the pressurized gas contained in the gas cylinder to flow out of the cylinder. The gas management device will thereafter direct the flow of gas into an inflatable unit, such as a life jacket, raft, etc., through a gas channel.

Figure 1:
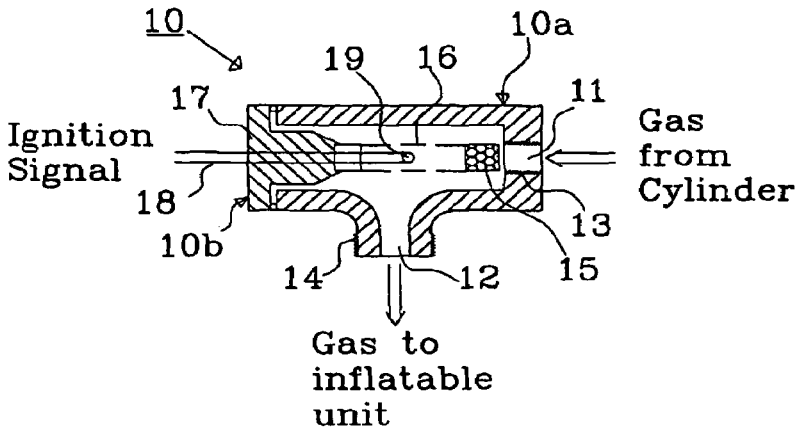
FIG. 1 shows a first embodiment of a gas management device according to the invention.

FIG. 1 shows a cross-sectional view of a first embodiment of a gas management device 10 comprising a manifold 10*a* and a puncture device 10*b*. The manifold 10*a* is provided with a gas inlet 11 and a gas outlet 12, and a gas cylinder (not shown) is intended to be secured to the gas inlet 11, and in this embodiment internal threads 13 are provided to mount the gas cylinder by screwing. An inflatable unit (not shown) is intended to be secured to the outlet 12 of the manifold 10*a*, and in this embodiment external threads 14 are provided. Examples of other types of means to secure the gas cylinder, and the inflatable unit, to the manifold 10*a* is gluing, press fitting, bayonet fitting, etc.

The puncture device 10*b* comprises a pyrotechnical detonator 16 and a holder 17. Igniting cables 18 are provided through the holder 17 and are connected to an igniting charge 19 of the pyrotechnical detonator 16. The detonator 16 further comprises an explosive charge 15 which is ignited by the igniting charge 19 when an igniting signal is supplied to the igniting cables 18. The holder 17 is attached to the manifold 10*a* in a suitable manner to create a gas tight seal, e.g. using O-rings and a threaded attachment (not shown). The components, i.e. the igniting charge 19 and the explosive charge 15, of the pyrotechnical detonator 16 are preferably contained within an optional tubular housing, e.g. made out of paper, to direct the bursting effect towards the inlet 11 of the gas management device 10, and to provide a path and directional guidance for the sparks from the igniting charge 19 when igniting the explosive charge 15.

In this embodiment, a gas channel between the inlet 11 and the outlet 12 may be present before the detonator 16 is activated as long as the detonator 16 is positioned a small distance from a closure (not shown) sealing an opening of the pressurized gas cylinder. A stimuli in the shape of an igniting signal is supplied to the igniting cables 18 that will ignite the igniting charge 19 and cause the explosive charge 15 to detonate. A chock wave is created by the detonation that will travel towards the closed opening and puncture the closure. An aperture is thus created in the closure and the gas contained in the cylinder will be released and flow into the manifold 10*a*. The pressurized gas will thereafter flow through the outlet 12 and inflate the inflatable unit.

Figure 2:
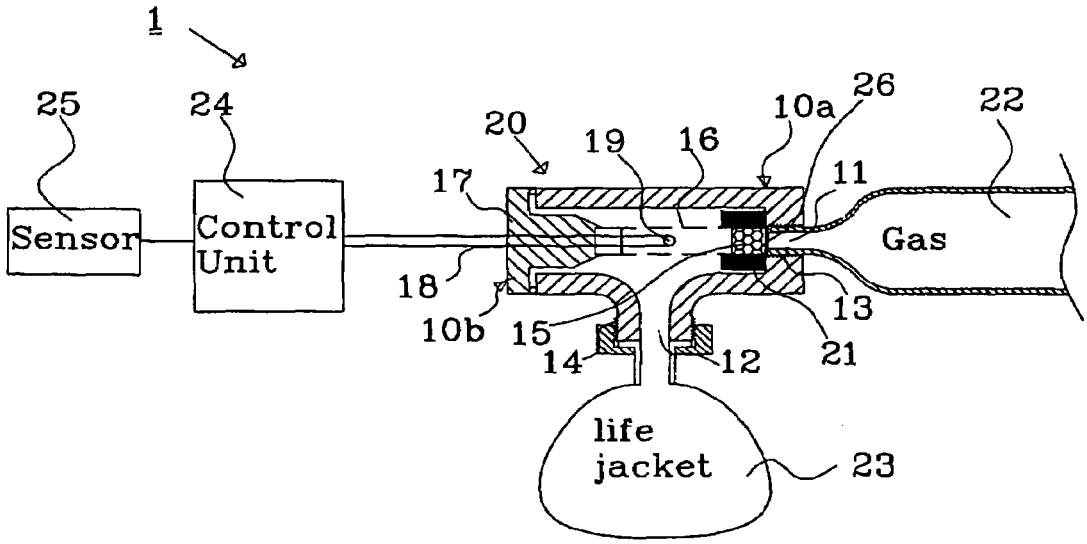
FIG. 2 shows an inflating system with a second embodiment of a gas management device according to the invention.

FIG. 2 shows a partly cross-sectional view of an inflating system 1 with a second embodiment of a gas management device 20 having the same parts as described in connection with FIG. 1 with the exception that a sleeve 21 has been provided around the charge 15 of the pyrotechnical detonator 16 instead of or in addition to the optional tubular housing. A closure 26 sealing an opening of a pressurized gas cylinder 22, e.g. containing air, $CO_2$, $NO_2$, a mixture of $CO_2/NO_2$, HFC gases, etc., is secured to the inlet 11 and a floating device, such as a life jacket 23 or a life raft (not shown), is secured to the outlet using threaded connections as described in connection with FIG. 1. A control unit 24 is connected to the igniting cables 18 and an electric signal is provided from a sensor 25, such as a capacitive sensor available from Secumar, to the control unit 24 when the sensor is in contact with water.

If the sensor detects water, the control unit sends an igniting signal (stimuli) via the igniting cables to the puncture device 10*b*. The sleeve 21 has a tight fit to the detonator 16 and the closure 26, whereby a gas channel is not provided between the inlet 11 and the outlet 12 before the detonator is activated. The gas channel will be created through an area where the explosive charge 15 of the pyrotechnical detonator 16 was situated before activation, and the pressurized gas will flow from the gas cylinder 22 through the sleeve 21 and into the inflatable unit, i.e. the life jacket 23 or life raft (not shown).

Figure 3A:
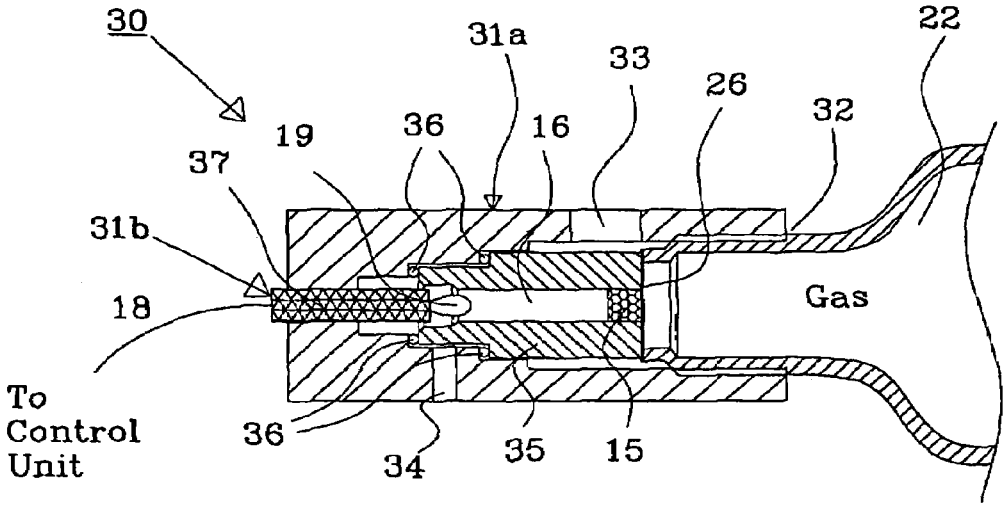
FIG. 3*a* shows a third embodiment of a gas management device according to the invention in a stand-by position.
Figure 3B:
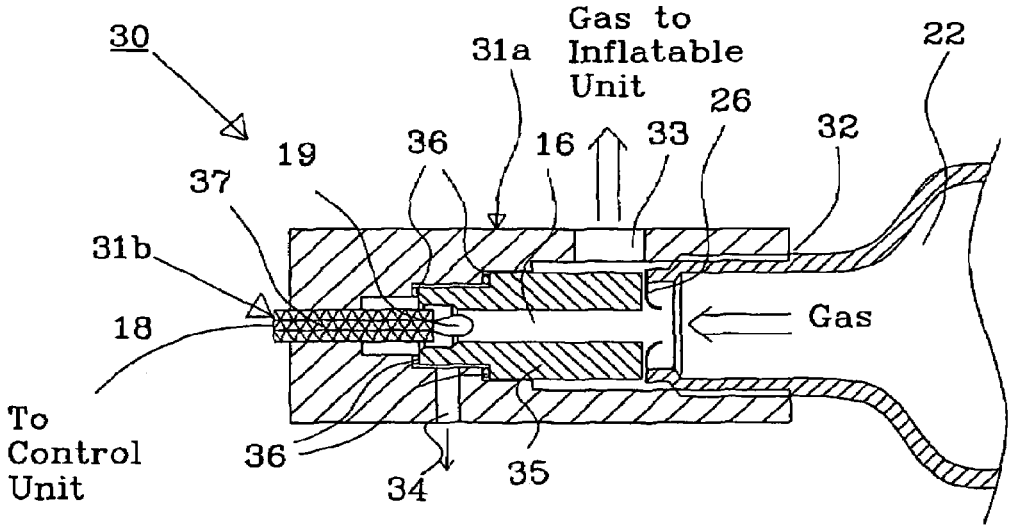
FIG. 3*b* shows the gas management device from FIG. 3*a* in an activated position.

FIGS. 3*a* and 3*b* show cross-sectional views of a third embodiment of a gas management device 30 in a stand-by position and in an activated position, respectively. A gas cylinder 22 being provided with a closure 26 is attached to an inlet 32 of a manifold 31*a* of the gas management device 30 as previously described in connection with FIGS. 1 and 2. The closure 26 could be any type of material that is strong enough to contain a pressurized gas in the gas cylinder 22, and at the same time may be punctured by a puncture device 31*b* when activated. An example of such a material is a plastic polymer material, or a metal, e.g. steel or aluminium.

An outlet 33 to which an inflatable unit (not shown) may be attached is provided in the manifold 31*a* close to the region where the closure 26 sealing the opening of the gas cylinder 22 is positioned when attached to the manifold 31. Additionally, a pressure equalizing channel 34 is provided through the manifold 31*a* to assist in direct pressurized gas from the gas cylinder 22 to the inflatable unit when the puncture device 31*b* is activated and the closure 26 is punctured.

The puncture device 31*b* comprises a detonator 16, comprising an explosive charge 15 and an igniting charge 19, which is arranged within a sleeve 35, and igniting cables 18 are arranged to be connected to a control unit (not shown). The explosive charge 15 of the detonator 16 and a first end of the sleeve 35 are arranged adjacent to the closure 26 before the activation of the detonator, see FIG. 3*a*. A second opposed end of the sleeve 35 is provided with two seals in the shape of O-rings 36 and the pressure equalizing channel 34 provides communication between the space delimited by the O-rings 36 and the surrounding environment. The puncture device 31*b* also comprises a holder 37 for the igniting charge provided through the manifold 31*a*.

FIG. 3*b* shows a state when the detonator has been activated by the control unit and the explosive charge 15 has exploded, and thereby punctured the closure 26 of the gas cylinder 22. Pressurized gas from the gas cylinder 22 flows out of the gas cylinder, and a force is created that pushes the sleeve 35 towards the second end of the sleeve and compresses the O-rings 36. The pressure equalizing channel 34 reduces the counter force that will act on the sleeve 35 and a gas channel is thus created between the inlet 32 and the outlet 33 through a passage created between the remaining parts of the closure 26 and the first end of the sleeve 35. The gas channel between the gas inlet 32 and the gas outlet 33 is thus circumventing the sleeve 35. The explosive charge 15 is blown to pieces due to the explosion and the sleeve 35, which probably will be deformed by the explosion, will protect the manifold 31*a* from being damaged.

Figure 4:
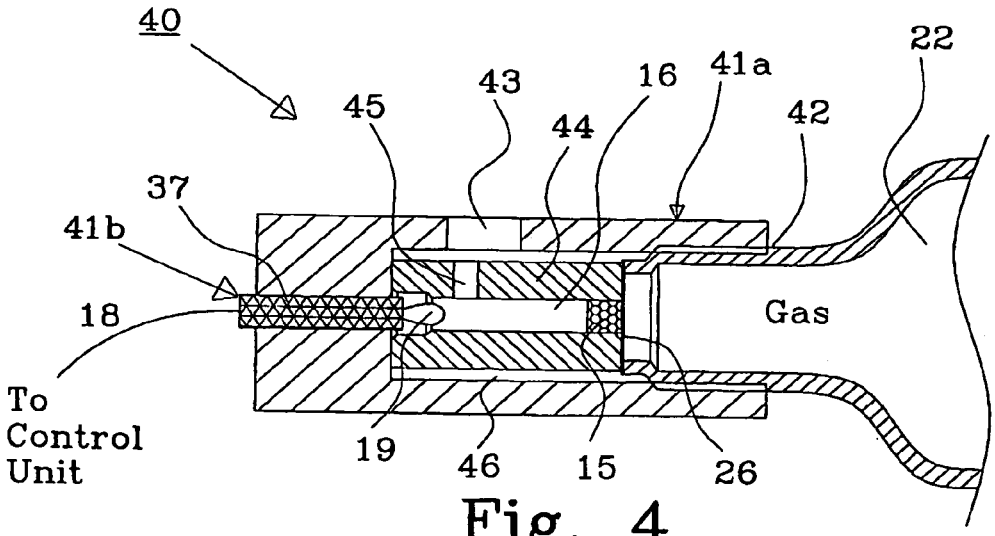
FIG. 4 shows a fourth embodiment of a gas management device according to the invention in a stand-by position.
Figure 5:
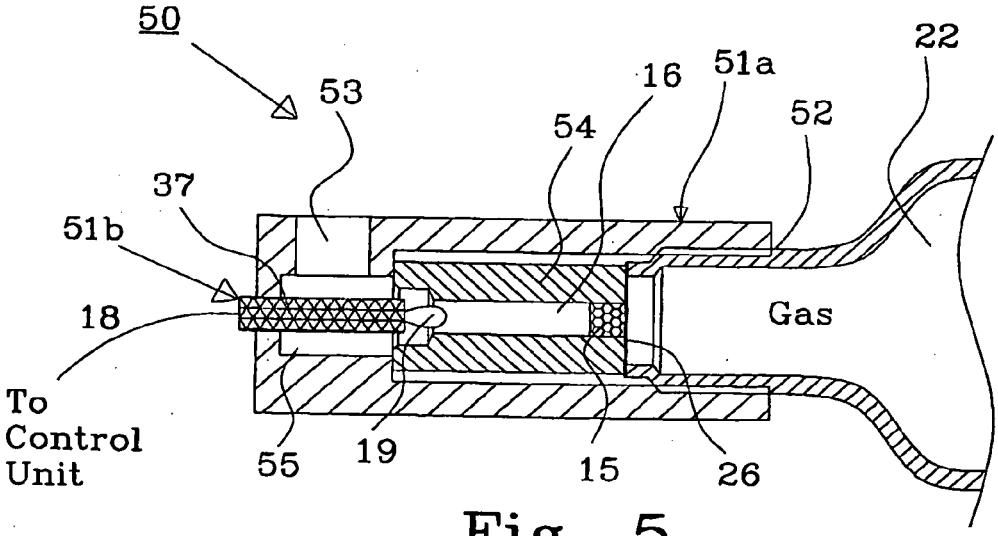
FIG. 5 shows a fifth embodiment of a gas management device according to the invention in a stand-by position.

FIGS. 4 and 5 show examples of alternative gas management devices without movable sleeves.

FIG. 4 shows a cross-sectional view of a fourth embodiment of a gas management device 40 according to the invention. A gas cylinder 22 is securely attached to an inlet 42 of a manifold 41*a*, as described in connection with FIGS. 3*a* and 3*b*. An outlet 43 to which an inflatable unit (not shown) may be attached is provided in the manifold 41*a*. A puncture device 41*b* including a holder 37 and a detonator 16 is provided through the manifold 41*a*. The detonator 16 comprises an igniting charge 19, which is held in place by the holder 37, and an explosive charge 15 provided within a sleeve 44. An opening 45 is provided through the sleeve 44, and preferably aligned with the outlet 43 provided in the manifold 41*a*. If a space 46 is provided between an outer surface of the sleeve 44 and an inner surface of the manifold 41*a*, an alignment is not necessary for the purpose of directing gas from the gas cylinder to the inflatable unit when the puncture device 41*b* is activated via igniting cables 18 and a closure 26 of the gas cylinder is punctured.

In the embodiment, a gas channel will then be created between the inlet 42 and the outlet 43 through the area where the explosive charge 15 was positioned before the explosion, through the opening 45 in the sleeve and the space 46 (if present). The position of the opening 45 and the outlet 43 should be selected to ensure that a gas channel will be created when the explosive charge 15 is detonated. In other words, the design of the detonator is critical to ensure proper operation.

FIG. 5 shows a cross-sectional view of a fifth embodiment of a gas management device 50 according to the invention. A gas cylinder 22 is securely attached to an inlet 52 of a manifold 51*a*, as described in connection with FIGS. 3*a* and 3*b*. An outlet 53 to which an inflatable unit (not shown) may be attached is provided in the manifold 51. A puncture device 51*b* including a holder 37 and a detonator 16 is provided through the manifold 51*a*. The detonator comprises an igniting charge 19, which is held in place by the holder 37, and an explosive charge 15 provided within a sleeve 54. A cavity 55 is provided around the holder 37 and the outlet 53 is in communication with the cavity 55.

In the embodiment, a gas channel will be created between the inlet 52 and the outlet 53 through the area where the explosive charge 15 was positioned before the explosion, around the igniting charge 19 and holder 37 and the cavity 55.

The invention described in connection with FIGS. 1-5 discloses a gas management device connected to a gas cylinder having a sealed opening, but the gas management device could be used to puncture any type of pressurized vessel (with or without a sealed opening) as long as the puncture device is dimensioned to be able to puncture the casing of the pressurized vessel.

Figure 6:
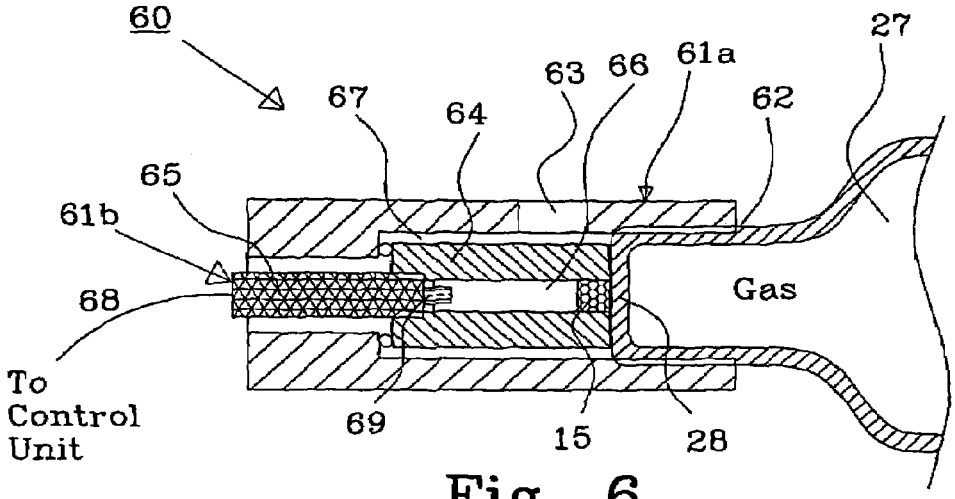
FIG. 6 shows a sixth embodiment of a gas management device according to the invention in a stand-by position.

FIG. 6 shows a sixth embodiment of a gas management device 60 according to the invention having a manifold 61*a* and a puncture device 61*b*. A pressurized vessel 27 with a casing 28 is attached to the manifold 61*a* in such a way that the puncture device 61*b* will puncture the casing 28 when activated. The manifold 61*a* is provided with a gas inlet 62 and a gas outlet 63. The puncture device 61*b* comprises a pyrotechnical detonator 66 arranged within a sleeve 64. The pyrotechnical detonator 66 comprises an explosive charge 15 arranged at a first end close to the casing 28 of the pressurized vessel 27 and an igniting stimuli 69 which is arranged to a holder 65. The holder is securely attached to a second end of the sleeve 64 using, for instance, a threaded connection. A stimuli, such as an optical signal is supplied to the igniting charge 69 which generate energy, e.g. laser pulses, that will travel trough the path created by the sleeve 64 and cause the explosive charge 15 to detonate.

A gas channel will be created between the gas inlet 62 and the gas outlet 63 when the explosive charge is detonated, since the position of the sleeve 64 will be shifted against o-rings provided at the second end of the sleeve 64, whereby the pressurized gas from the vessel 27 circumvent the sleeve 64 and flows through a space 67 provided between the sleeve 64 and the manifold 61*a* to the gas outlet 63, which is adapted to be connected to an inflatable unit (not shown), such as a floating device.

Figure 7:
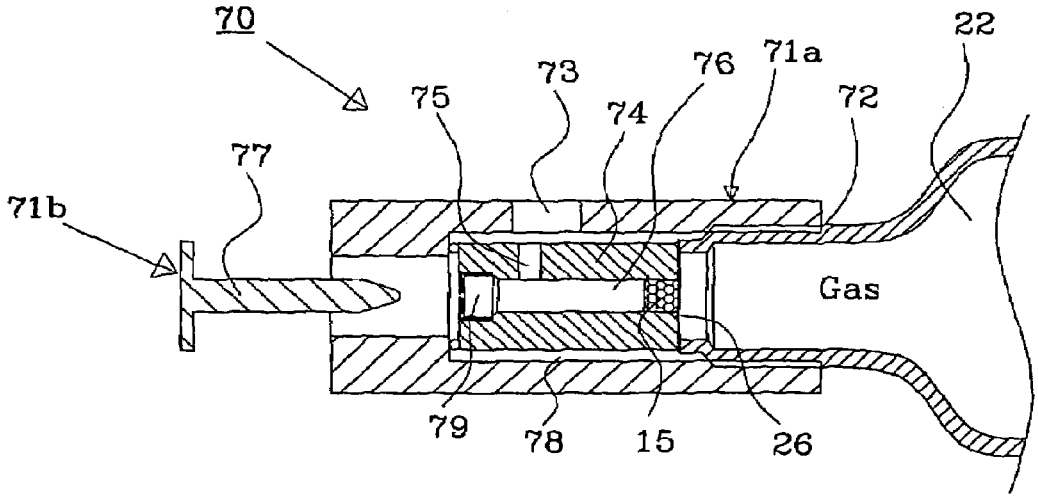
FIG. 7 shows a seventh embodiment of a gas management device according to the invention in a stand-by position.

FIG. 7 shows a cross-sectional view of a seventh embodiment of a gas management device 70 with a mechanically activated pyrotechnical detonator. A gas cylinder 22 is securely attached to an inlet 72 of a manifold 71*a*, as described in connection with FIGS. 3*a* and 3*b*. An outlet 73 to which an inflatable unit (not shown) may be attached is provided in the manifold 71*a*. A puncture device 71*b* including a striking pin 77 and a detonator 76 is provided. The detonator 76 comprises a percussive primer 79, which is secured to a sleeve 74, and an explosive charge 15 provided within the sleeve 74. An opening 75 is provided through the sleeve 74, and preferably aligned with the outlet 73 provided in the manifold 71*a*. If a space 78 is provided between an outer surface of the sleeve 74 and an inner surface of the manifold 71*a*, an alignment is not necessary for the purpose of directing gas from the gas cylinder to the inflatable unit when the puncture device 71*b* is activated by pushing the striking pin 77 (stimuli) against the percussive primer 79. Ignition sparks created in the percussive primer 79 will activate the explosive charge 15 and a closure 26 of the gas cylinder is punctured.

In the embodiment, a gas channel will then be created between the inlet 72 and the outlet 73 through the area where the explosive charge 15 was positioned before the explosion, through the opening 75 in the sleeve and the space 78 (if present). The position of the opening 75 and the outlet 73 should be selected to ensure that a gas channel will be created when the explosive charge 15 is detonated. In other words, the design of the detonator is critical to ensure proper operation.

Figure 8A:
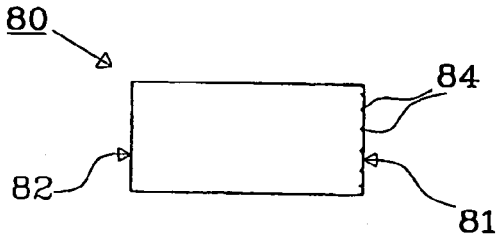
FIGS. 8*a* and 8*b* shows an alternative embodiment of a sleeve for use in connection with the gas management device according to the invention.
Figure 8B:
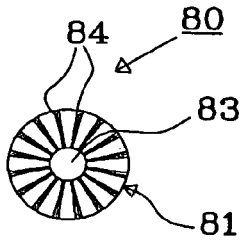

FIGS. 8*a* and 8*b* show an alternative embodiment of a sleeve 80 used in a gas management device where the pressurized gas is circumventing the sleeve after the closure or casing has been punctured, e.g. the embodiments described in connection with FIGS. 3*a*, 3*b* and 6.

FIG. 8*a* shows a side view of the sleeve 80 which is cylindrical and is provided with a first end 81 and a second end 82. FIG. 8*b* shows a view of the first end of the sleeve 80 and an opening 83 is provided between the first end 81 and the second end 82 through the centre of the sleeve 80. The size of the opening 83 is adapted to secure an explosive charge (as previously described). Grooves 84 are arranged in a radial pattern on the first side 81 of the sleeve 80. The first side 81 of the sleeve 80 is preferably arranged against the closure 26, or casing 28, of the pressurized vessel, whereby the gas channel between the gas inlet and the gas outlet is directed through the grooves 84.

The sleeve described in connection with FIGS. 2-8 is preferably made from a material that will withstand the force created by the explosive charge when activated, e.g. metal, such as aluminium or steel, plastic or paper. One of the objectives of the sleeve is to protect the manifold from the explosion; another objective is to direct the bursting effect towards the closure of the gas cylinder and to control the velocity of the gas flow from the gas cylinder to the inflatable unit, such as a floating device. A cylindrical shape is preferred, but the invention should not be limited to this. It is also possible to integrate the sleeve with the manifold.

Variations in the design of the gas management device are possible within the scope of the claims.

The pyrotechnical detonator 16, 66, 76 is influenced by igniting stimuli, and comprises an igniting charge, such as an electrically activated igniting charge 19, an optical device 69 or a manually activated percussive primer 79. The igniting charge is adapted to generate sparks that will ignite the explosive charge 15. A distance between the igniting charge and the explosive charge 15 is advisable to avoid unintentional activation of the detonator.

Figure 9:
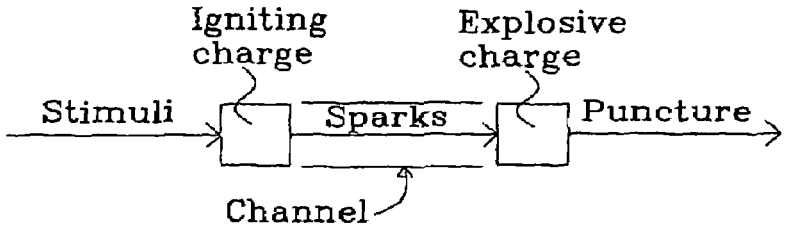
FIG. 9 shows a block diagram describing the principal mode of operation of a pyrotechnical detonator.

FIG. 9 shows a block diagram describing the principal mode of operation of a pyrotechnical detonator that could be used in the above described embodiments of the invention. A stimuli, such as an electrical signal, optical signal, or a manual movement of a striking pin, affects an igniting charge. The igniting charge will emit energy, preferably in the shape of sparks that are conveyed through a dead space to the explosive charge. The correct amount of energy will cause the explosive charge to detonate and created a shock wave that will puncture a closure (or casing) of a pressurized vessel.

Details of the Detonator Material

The ignition train and sequence of events, as illustrated in FIG. 9, comprises an ignition stimuli, a donor charge (igniting charge), a channel guiding the ignition sparks, and an acceptor output charge (explosive charge) to perform mechanical work. The idea is to have an underbalanced donor charge of the described composition with regard to oxygen. This creates sparks with extremely good ignition characteristics, which easily can be guided through a tube or channel to an acceptor charge.

The sparks from this novel composition have a unique capability to directly ignite materials that normally would require a priming layer in order to take fire reliably. Lead azide is such a material that will not reliably take fire from a prior art black powder composition or most hot slag producing compositions. Lead azide will, however, reliably ignite from this novel composition, even when the sparks are guided through a channel for several centimeters. The required composition depends mainly on the physical size of the system, length of the ignition transfer channel and type of acceptor charge. The composition of the ignition donor comprises the following components: A, B, and C, wherein C is optional.

A) Black powder type composition comprising: potassium nitrate ($KNO_3$), charcoal, and optionally sulphur (S).

The potassium nitrate is preferably in the range 50 to 80% by weight, more preferably 60 to 80% by weight, even more preferably 65 to 78% by weight, and is preferably milled, more preferably ball milled into particles.

The charcoal is preferably in the range 15 to 30% by weight, more preferably 15 to 25% by weight, and is preferably, as a non-limiting example, milled and screened to 80 mesh.

The optional sulphur is preferably in the range 0 to 20% by weight, more preferably 0 to 10% by weight, and is preferably milled into particles.

B) Ignition transfer material comprising a Group IV element, preferably Titanium (Ti) or Zirconium (Zr), more preferably Titanium (Ti). The ignition transfer material is preferably provided as: sponge, flake, or powder, having a particle size in the range 25 μm to 500 μm, depending on ignition distance.

The ignition distance is preferably in the range 1 mm to 30 mm, wherein a larger particle size of the ignition transfer material is needed for increasing ignition distance. Too small particles give a flash explosion with the deflagration being too fast to achieve dependable ignition and too large particles do not burn well. The optimum particle size for a particular geometry of the detonator will emit particles that will hit the acceptor charge while still burning as a mixture of the metal and its oxides. These particles will have extremely good heat transfer properties, and do not just bounce off the surface they hit, as sparks generally tend to do.

C) Optional binder, which preferably comprises: nitrocellulose (NC), stabilizer, plasticiser, phlegmatizer, and solvent.

The nitrocellulose comprises nitrogen preferably in the range 12 to 13% by weight, more preferably close to 12.6% by weight.

The stabilizer is preferably urea which preferably is provided in small quantities, e.g. in the range 0 to 1% in weight.

The plasticiser and phlegmatizer is preferably camphor, which preferably is provided in the range 0 to 30% in weight.

The solvent is preferably acetone, preferably well dried. MEK (Methyl Ethyl Ketone), and a number of organic esters such as isoamylacetate are other possible solvents in order to adjust the drying rate to suit the process.

The optional binder may also be used to regulate the burning rate of the composition. It may also be used to reduce the amount of dust during production of a granulated composition Preferred Composition A preferred composition for the donor charge (igniting charge) is as follows:

A) 80% by weight, and

B) 20% by weight.

wherein

A) comprises $KNO_3$ 75% by weight, S 10% by weight, and Charcoal 15% by weight, mixed together in a suitable process, e.g. screen mixed 3 times through 40 mesh.

B) comprises Ti sponge with particle size of 100 μm

Optionally, the above described composition may be diluted by C) comprising NC thinned with acetone to proper dipping rheology to an extent that the component C constitutes up to 10% by weight of the final composition. With the composition including component C it is possible to get a dipping rheology similar to prior art production of matches where animal hide glue is used as the binder.

The above described material has similar properties as achieved with hide glue. The dipped igniters come out nicely drop shaped and dry hard. This is difficult to achieve with most of the metal powder and oxidizer combinations well known as igniters. The black powder type composition lowers ignition temperature in order to create a single dip system. Most commercial matches use 2 or 3 dips with a sensitive first fire layer and successive output charge layers to produce molten slag and sparks.

If a first sensitizer dip is necessary, as in very low current electric bridge wire igniters or optical igniters used as ignition stimuli, then the black powder type composition should preferably be sulphurless. 70% $KNO_3$ and 30% Charcoal works well as component A. The reason for this is the incompability of sulphur with the chlorates usually used in such sensitive igniters.

The preferred distance between donor charge and the acceptor charge is 10 mm. The width of the channel is 1 to 5 mm with the preferred diameter being 2 mm. The ignition channel can be curved, s shaped or some other complex geometry.

The lead azide acceptor charge is preferably a type that has a short deflagration to detonation transition, DDT, after ignition of the acceptor charge. This depends a lot on the type of co-precipitants used and on the exact process parameters used in the production of the lead azide. Silver azide is another possible material that has a very short DDT. Thus lead and silver azide are two examples of suitable acceptor charges that can be used according to the invention. Other materials having a corresponding short DDT can also be used.

The preferred device consists of an aluminium cylinder with a 2 mm hole axially through its centreline. The acceptor output charge end of the cylinder comprises e.g. 20 mg of lead azide pressed into a small pellet. The spark producing donor charge is placed in the opposing end of the hole and sealed in. This arrangement is similar to what is well known from prior art as seen in electric basting caps, which usually contain a commercial electric match head and a very sensitive receptor charge to transfer fire to the output charge, usually lead azide and pentaerythritol tetranitrate (PETN). However, the present invention does not need a sensitive receptor charge in this configuration, as is common in the prior art.

The invention claimed is:

1. A gas management device, comprising:

a gas inlet adapted to secure a casing of a vessel containing pressurized gas, a gas outlet adapted to be secured to an inflatable unit, and a puncture device for puncturing the casing, whereby gas from the vessel is directed to the inflatable unit, wherein said puncture device includes a pyrotechnical detonator having an igniting stimuli and an explosive charge arranged adjacently to the gas inlet, said igniting stimuli being configured to emit energy when activated, such that the energy activates the explosive charge to create a shock wave which punctures the casing of the vessel, and said pyrotechnical detonator being configured to create a gas channel between the gas inlet and the gas outlet when the puncture device is activated.

2. The gas management device according to claim 1, wherein the vessel is a gas cylinder provided with a closure sealing an opening of the gas cylinder, wherein the puncture device punctures the closure when activated.

3. The gas management device according to claim 1, wherein the gas management device further comprises a sleeve cylindrically arranged around the pyrotechnical detonator.

4. The gas management device according to claim 3, wherein the material of the sleeve is paper, or metal, or plastic.

5. The gas management device according to claim 3, wherein the gas management device further comprises a gas channel between the gas inlet and the gas outlet circumventing the sleeve.

6. The gas management device according to claim 3, wherein a first end of the sleeve is arranged adjacent to the gas inlet, and a second opposed end of the sleeve is provided with a compressible seal, said gas management device further is configured to push the sleeve against said compressible seal when the puncture device is activated to circumvent the first end of the sleeve to create the gas channel.

7. The gas management device according to claim 6, wherein the compressible seal includes two O-rings, and the gas management device further includes a pressure equalizing channel configured to provide communication between a space delimited by the O-rings and the surrounding environment.

8. The gas management device according to claim 1, wherein the gas channel passes through an area where the explosive charge of the pyrotechnical detonator was situated before activation.

9. The gas management device according to claim 8, wherein the gas management device further comprises a sleeve cylindrically arranged around the pyrotechnical detonator, said sleeve being provided with an opening through which the gas channel being created when the puncture device is activated.

10. The gas management device according to claim 8, wherein the gas management device further comprises a sleeve cylindrically arranged around the pyrotechnical detonator, and a cavity connected to said gas outlet, said gas channel being created through said sleeve and cavity when the puncture device is activated.

11. The gas management device according to claim 1, wherein said inflatable unit is a floating device.

12. A method for transferring gas from a pressurized gas cylinder to an inflatable unit through a gas management device having a gas inlet, a gas outlet and a puncture device, the method comprising:

securing a casing of a vessel to the gas inlet of the management device, securing the inflatable unit to the gas outlet of the management device, providing a pyrotechnical detonator having an igniting stimuli and an explosive charge arranged adjacently to the gas inlet as a part of the puncture device, activating the igniting stimuli of the pyrotechnical detonator to create a shock wave to puncture the casing of the vessel, and creating a gas channel between the gas inlet and the gas outlet when the puncture device is activated.

13. The method according to claim 12, wherein the casing of the vessel is a closure sealing an opening of a pressurized gas cylinder, and the closure is punctured by the puncture device when activated.

14. The method according to claim 12, wherein the inflatable unit is selected to be a floating device.

15. The method according to claim 12, wherein the shock wave creates a gas channel between the gas inlet and the gas outlet through an area where the explosive charge of the pyrotechnical detonator was situated before activation.

16. A system for inflating an inflatable unit including a pressurized vessel, said inflatable unit and said pressurized vessel being secured to a management device, the system comprising:

a gas inlet to which a casing of the pressurized vessel containing pressurized gas is secured, a gas outlet to which an inflatable unit is secured, and a puncture device for puncturing the casing, whereby gas from the vessel is directed to the inflatable unit, wherein said puncture device includes a pyrotechnical detonator having an igniting stimuli and an explosive charge arranged adjacently to the gas inlet, said igniting stimuli being configured to emit energy when activated, such that the energy activates the explosive charge to create a shock wave which punctures the casing of the vessel, and said pyrotechnical detonator being configured to create a gas channel between the gas inlet and the gas outlet when the puncture device is activated.

17. The system according to claim 16, wherein the vessel is a gas cylinder containing pressurized gas.

18. The system according to claim 16, wherein said system further comprises a sensor and a control unit, the sensor sends a water indicative signal to the control unit which in turn sends an igniting signal through igniting cables to activate the igniting stimuli of the pyrotechnical detonator.

* * * * *